United States Patent [19]

Mineart

[11] Patent Number: 4,889,347

[45] Date of Patent: Dec. 26, 1989

[54] FLYING DISK WITH FLEXIBLE CENTER

[76] Inventor: Michael V. Mineart, 641 Canterbury Ave., Livermore, Calif. 94550

[21] Appl. No.: 278,568

[22] Filed: Dec. 1, 1988

[51] Int. Cl.[4] ..... A63H 27/00
[52] U.S. Cl. ..... 273/424
[58] Field of Search ..... 273/424; 446/46, 47

[56] References Cited

U.S. PATENT DOCUMENTS

| | | | |
|---|---|---|---|
| 3,359,678 | 12/1967 | Headrick | 273/424 |
| 3,948,523 | 4/1976 | Michael | 273/424 |
| 4,173,839 | 11/1979 | Kovac | 446/46 |
| 4,204,357 | 5/1980 | Harrington | 446/47 |
| 4,212,131 | 7/1980 | Ross, Jr. | 446/46 X |
| 4,248,010 | 2/1981 | Fox | 273/424 X |
| 4,334,385 | 6/1982 | Melin et al. | 446/46 |
| 4,681,553 | 7/1987 | Rodarte | 446/46 |

OTHER PUBLICATIONS

1988 Spin Jammer AD, Sandeen Inc., patents pending.

*Primary Examiner*—Paul E. Shapiro

[57] ABSTRACT

A flying disk that allows for easier performance of tricks without degrading the flight performance of the flying disk. The flying disk includes a center opening over which a stretchable membrane is attached. This stretchable membrane deflects under the weight of the flying disk and helps in the performance of tricks that involve a spinning flying disk supported at its center by an object such as the finger of the person performing the trick. The stretchable membrane is replaceable with other membranes that allow various amounts of deflection and therefore require more or less skill to perform tricks with. Also the replaceable flexible membranes can be made in different colors or contains logos or designs. These variations allow the user of the flying disk to configure his or her own flying disk to their specific use, needs or liking.

3 Claims, 2 Drawing Sheets

FLYING DISK WITH FLEXIBLE CENTER

BACKGROUND OF THE INVENTION

Field of the Invention

The present invention relates to flying disks, and more particularly, to the feature on the flying disk which allows for the performance of different types of tricks and or uses.

Flying disks are recreational devices of a round configuration that are thrown with a spinning motion between one or more individuals for the sake of exercise and entertainment. Tricks are also performed by individuals by balancing a spinning flying disk on the tip of a finger, some other part of the anatomy, or a object. The performance of these tricks is difficult to accomplish due too the flat nature of the center portion of a standard flying disk in that the disk will tend to mislocate unless the individual has a significant level of skill. There are currently flying disks that do incorporate features that allow for easier performance of simple tricks, but these features are a permanent part of the disk, do not allow for different skill levels, tend to not allow for the performance of more complicated tricks and degrade the flight performance of the flying disk, which is the main purpose of the flying disk.

SUMMARY OF THE INVENTION

The present invention allows for easier performance of tricks with flying disks and incorporates features which allows the user to vary the skill level required to perform tricks, without degrading the flight performance of the flying disk. This is accomplished by incorporating an opening with a diameter of at least one fifth of the overall diameter of the flying disk at the center of the flying disk which is covered with a thin stretchable membrane, which when supported on by an object, allows for the formation of a depression or cone of a depth equal to at least one sixth of the diameter of the stretchable membrane which helps prevent mislocation of the flying disk and allows for the easier performance of tricks.

The flying disk is of a standard construction with the exception of an opening located at the center of the flying disk. The opening incorporates a lip or feature which allows various membranes to be removed or installed without the use of tools.

The thin stretchable membrane has a lip or feature which allows for installation and removal from the flying disk without the use of tools. The membrane is of a construction that allows for the formation of a cone or depression when the spinning flying disk is centered and supported by an object and only the weight of the flying disk is acting on the membrane. The membrane can be made available in various configurations which will allow for various amounts of depression and therefore various degrees of difficulty in performing tricks. The membrane can also be manufactured in various colors or incorporate logos or designs so that an owner of the flying disk can configure the disk to a configuration suited to his or hers level of ability or tastes.

DESCRIPTION OF THE PREFERRED EMBODIMENT

Figure 1:
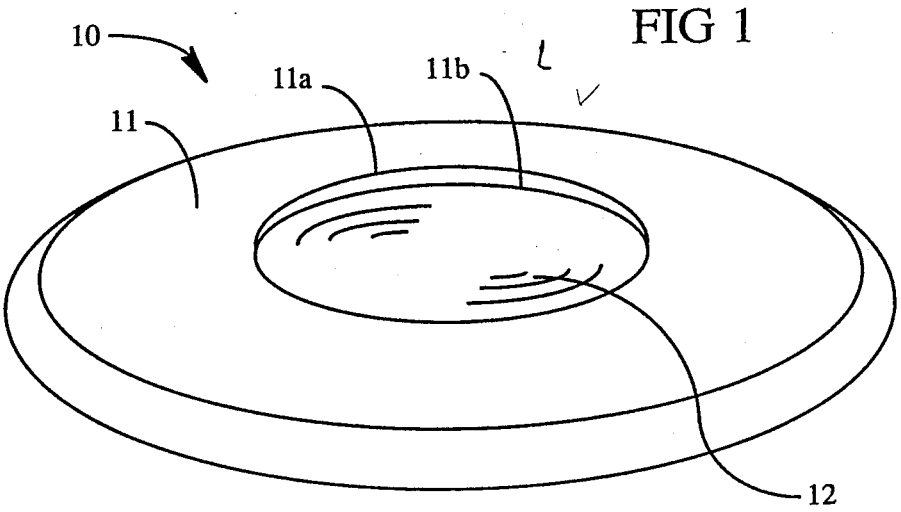
FIG. 1 is an isometric drawing of the present invention.
Figure 2A:
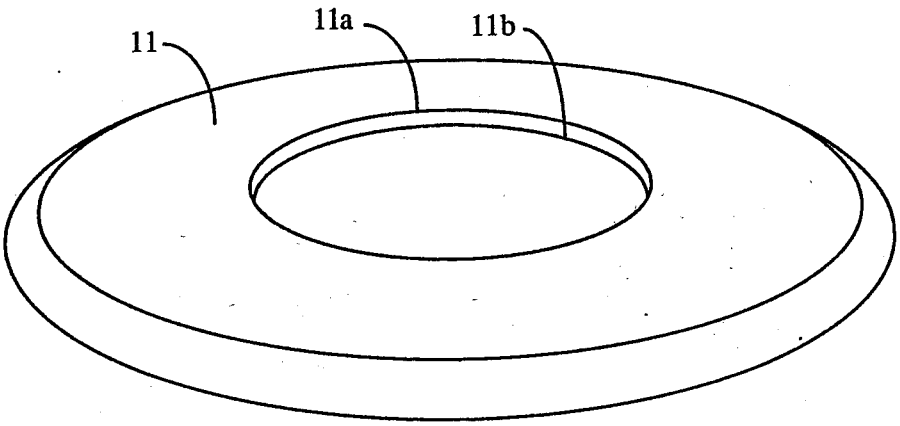
FIG. 2*a* is an isometric top view of the lift body.
Figure 2B:
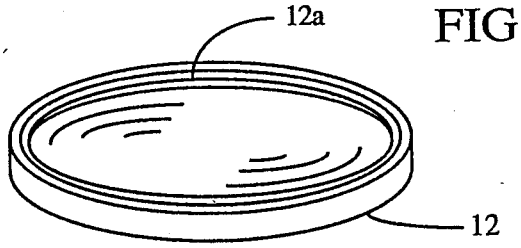
FIG. 2*b* is an isometric top view of the stretchable membrane.
Figure 3:
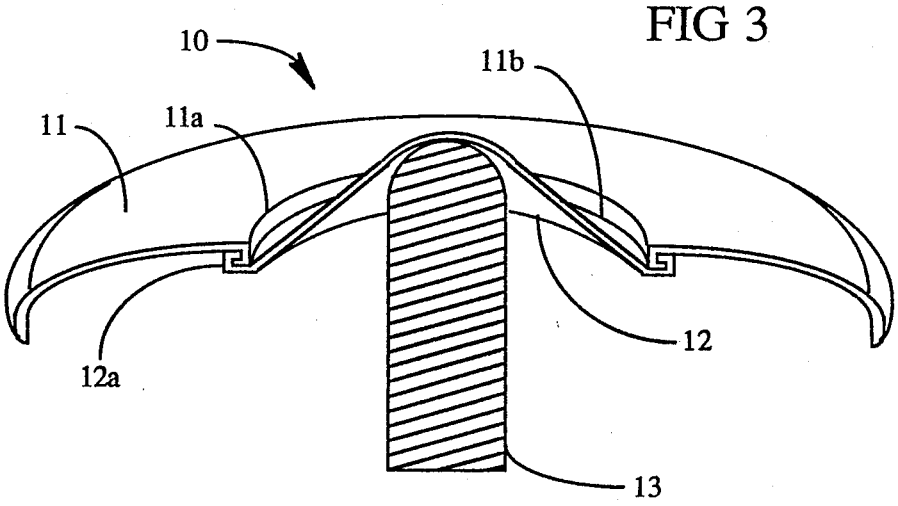
FIG. 3 is a section through the stretchable membrane and flying membrane body showing the stretchable membrane in a deformed configuration as would be seen in use.

A flying disk 10 of the present invention includes a flying disk lifting body 11 having a central opening 11*a* with a diameter equal to at least one fifth of the overall diameter of the flying disk lifting body and a replaceable stretchable device or membrane 12 that will under go a conical deformation an amount equal to at least one sixth of the diameter of the flexible device, and in a direction generally perpendicular to the undeformed surface of the flexible device, when acted on by a load about its center and due only to the weight of the flying disk lifting body member.

The central opening 11*a* of the flying disk lifting body 11 incorporates a rim or feature 11*b* which allows for the retention and assembly of the stretchable membrane 12 even while the flexible membrane under goes a conical deformation.

The stretchable membrane 12 also incorporates a mating rim or feature 12*a* that allows for retention during membrane deformantion and assembly to the flying disk central opening feature 11*b*. The construction of the the stretchable membrane 12 can vary to give various amounts of deflection when the flying disk 10 is supported by an object 13. The stretchable membrane 12 may also be constructed in different colors and or with various logos or designs incorporated. The flexible elastomeric membrane 12 may also be treated with chlorine to lower the coefficient of friction between the membrane 12 and the object 13.

The incorporation of the flying disk lifting body rim or feature 11*b* and the stretchable membrane mating rim or feature 12*a*, allows for easy removal and replacement of the stretchable membrane 12 with stretchable membranes of different characteristics or properties.

Thus, the present invention allows for the easier performance of tricks without degradation to flight performance due to the use of a easily removable and replaceable flexible membrane.

Although the best mode contemplated for carrying out the present invention has been herein shown and described, it will be apparent that modification and variation may be made without departing from what is regarded to be the subject matter of the invention.

What is claimed is:

1. A flying disk comprising a lifting body member containing a central aperture with a diameter of at least one fifth of the overall diameter of the flying disk to which is attached a stretchable device, wherein the device is of a generally circular shape and is formed from stretchable materials which will deform to create a conically concave depression of a depth equal to at least one sixth of the diameter of the said stretchable device in a direction generally perpendicular to the undeformed surface of the said stretchable device when acted on by a load no greater than a load equal to the weight of the flying disk lifting body member and located generally about the center of the stretchable device;

means defining for removably fastening said body member and center stretchable devices together.

2. The flying disk lifting body member of claim 1, comprising:

means defining an aperture in the said flying disk lifting body member including accurate portions;

means defining a rim within said aperture for removably attaching various stretchable devices; and locking means having sections within said rim for securing the said stretchable device on the said rim and retaining the said stretchable device on the said rim while the said device deforms an amount of at least one sixth of the diameter of the said stretchable device in a direction generally perpendicular to the undeformed surface of the said stretchable device.

3. The stretchable device of claim 1, comprising:

means defing a rim about the periphery of said stretchable device for removably attaching the said device to flying disk lifting body member; and locking means having sections about said rim for securing the said stretchable device on the flying disk lifting body member and retaining the said stretchable device to the flying disk lifting body member while the said device deforms an amount of at least one sixth of the diameter of the said stretchable device in a direction generally perpendicular to the undeformed surface of the said stretchable device.

* * * * *